US006266992B1

(12) United States Patent
Butcher et al.

(10) Patent No.: US 6,266,992 B1
(45) Date of Patent: Jul. 31, 2001

(54) MODULAR TOOLING SYSTEM FOR LANE TOOLING IN A CONVERSION PRESS AND METHOD FOR THE USE THEREOF

(75) Inventors: Gregory H. Butcher, Lima; Greg S. Williams, Wapakoneta, both of OH (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/382,540

(22) Filed: Aug. 25, 1999

Related U.S. Application Data

(60) Provisional application No. 60/103,178, filed on Oct. 6, 1998.

(51) Int. Cl.[7] ..... B21D 22/00; B21D 37/04

(52) U.S. Cl. ..... 72/478; 72/481.3; 72/481.9; 83/698; 413/15

(58) Field of Search ..... 72/478, 481.9, 72/482.5, 482.91, 482.93, 481.1, 481.3; 413/12, 15; 83/698

(56) References Cited

U.S. PATENT DOCUMENTS

| | | | | |
|---|---|---|---|---|
| 1,785,495 | * | 12/1930 | Richard | 83/698 |
| 2,377,191 | * | 5/1945 | Teachout | 83/698 |
| 4,170,890 | * | 10/1979 | Kojima | 72/359 |
| 4,760,729 | | 8/1988 | Kaminski | 72/456 |
| 5,119,924 | | 6/1992 | Kaminski | 198/803.15 |
| 5,317,894 | * | 6/1994 | Southard | 72/481 |
| 5,738,237 | | 4/1998 | McEldowney | 220/269 |
| 5,749,257 | | 5/1998 | McEldowney | 72/354.6 |
| 5,755,134 | | 5/1998 | McEldowney | 72/356 |

* cited by examiner

*Primary Examiner*—David Jones
(74) *Attorney, Agent, or Firm*—Thomas R. Trempus

(57) ABSTRACT

A modular tooling system for use in combination with a conversion press has an upper base member adapted to be removably mounting into the conversion press, a tooling holder, a tooling insert and means for retaining the tooling insert within the tooling holder. The tooling holder is adapted for attachment to the upper base member. The tooling holder defines a chamber therein extending therethrough. The chamber includes a shoulder portion. The tooling insert is adapted to be removably mounted in the tool holder. The insert has a first end, a second end, and a shoulder portion adapted to cooperate with the tooling holder shoulder portion. Bushings and spacers secure the insert within the tooling holder. Both the tooling holder chamber and the tooling insert are of a predetermined cross section which are adapted to correspond with each other and define a keyed relationship.

35 Claims, 5 Drawing Sheets

MODULAR TOOLING SYSTEM FOR LANE TOOLING IN A CONVERSION PRESS AND METHOD FOR THE USE THEREOF

RELATED APPLICATIONS

This application claims the benefit of U.S. Provisional Application No. 60/103,178, filed Oct. 6, 1998.

FIELD OF THE INVENTION

The invention provides a modular tooling system for use in conversion presses. More particularly, the invention provides a method for the use of modular tooling and the repair and refurbishment thereof.

BACKGROUND OF THE INVENTION

It is well known to manufacture various types of easy open style ends for use in the packaging of beer and beverages in cans. Such easy open ends typically include a tab, which is secured to an end panel by means of an integral rivet formed in the panel. A score line is formed in the end in order to define a tear-away panel portion which is ruptured and separated from the panel when the tap is lifted. The design and operation of such easy open can ends are fully described in U.S. Pat. Nos. 5,749,257; 5,755,134; and 5,738,237, which are assigned to the assignee of the instant invention, and the contents of which are incorporated herein by reference.

In the manufacture of such easy open can ends for use in the beer and beverage industry, an end shall is conveyed through a conversion press having a set of lane tooling. The lane tooling typically defines between six to eight discrete stations at which various metal working operations are performed on the end shell. The metal working operations include the formation of an integral rivet in the end shell to which a tab is eventually attached and the scoring of the end shell panel to define that portion of the panel which is ruptured and torn away from the panel during the opening operation. The lane tooling comprises upper and lower tooling members mounted in the conversion press for reciprocal movement toward and away from each other. Such conversion presses are well know and are taught in U.S. Pat. Nos. 4,760,729 and 5,119,924, which are assigned to the assignee of the instant invention, and the contents of which are incorporated herein by reference.

A conversion press is capable of operating at speeds of 600 strokes per minute and is typically operated around the clock to maximize the output of easy open ends. This level of use results in wear to the lane tooling, particularly the score tool, and the need for its periodic maintenance and replacement. It is the current practice to utilize tool steel for the manufacture of, for example, the score tool of the lane tooling. While a generally acceptable working life is achieved with tool steel, this material is expensive and difficult to work with. It is not uncommon to experience a thirty percent scrap rate in the manufacture of score tooling.

It is an object of this invention to provide a modular tooling system for use in the lane tooling of a conversion press.

It is another object of this invention to provide a modular tooling system which simplifies the manufacturer and assembly of tooling members, particularly tooling members subject to excessive wear.

It is yet another object of this invention to provide a method for the replacement of wear tooling that reduces the cost of the tooling and the time necessary for the manufacture and assembly of replacement tooling.

It is still another object of this invention to provide a modular tooling system which permits the simplified system of refurbishing wear tooling and ensuring the precise alignment of the working face of a complex tooling element.

SUMMARY OF THE INVENTION

The invention is a modular tooling system that is particularly well suited for use in combination with a conversion press. The tooling system comprises an upper base member adapted to be removably mounting into the conversion press, a tooling holder, a tooling insert and means for retaining the tooling insert within the tooling holder. The tooling holder has a first face adapted for attachment to the upper base member, and a second face opposite thereto. The tooling holder defines a chamber therein extending from the first face to the second face. The chamber includes a shoulder portion. The tooling insert is adapted to be removably mounted in the tool holder. The insert has a first end, a second end, and a shoulder portion adapted to cooperate with the tooling holder shoulder portion. Retaining means, such as bushings and spacers secure the insert within the tooling holder. Both the tooling holder chamber and the tooling insert are of a predetermined cross section which are adapted to correspond with each other and define a keyed relationship.

The tooling insert may be removed for refurbishing and then reassembled into the tooling holder for placement in the conversion press. The retaining means comprise at one set of spacers of a first dimension and at least a second set of spacers of a second, different dimension. As the tooling insert is refinished to restore the metal working features to it, any loss in the overall length of the insert is compensated for by the spacers.

BRIEF DESCRIPTION OF THE DRAWINGS

The above as well as other features and advantages of the instant invention can be more readily appreciated through consideration of the detailed description of the invention in conjunction with the several drawing in which.

DETAILED DESCRIPTION OF THE PREFERRED EMBODIMENT

Figure 1:
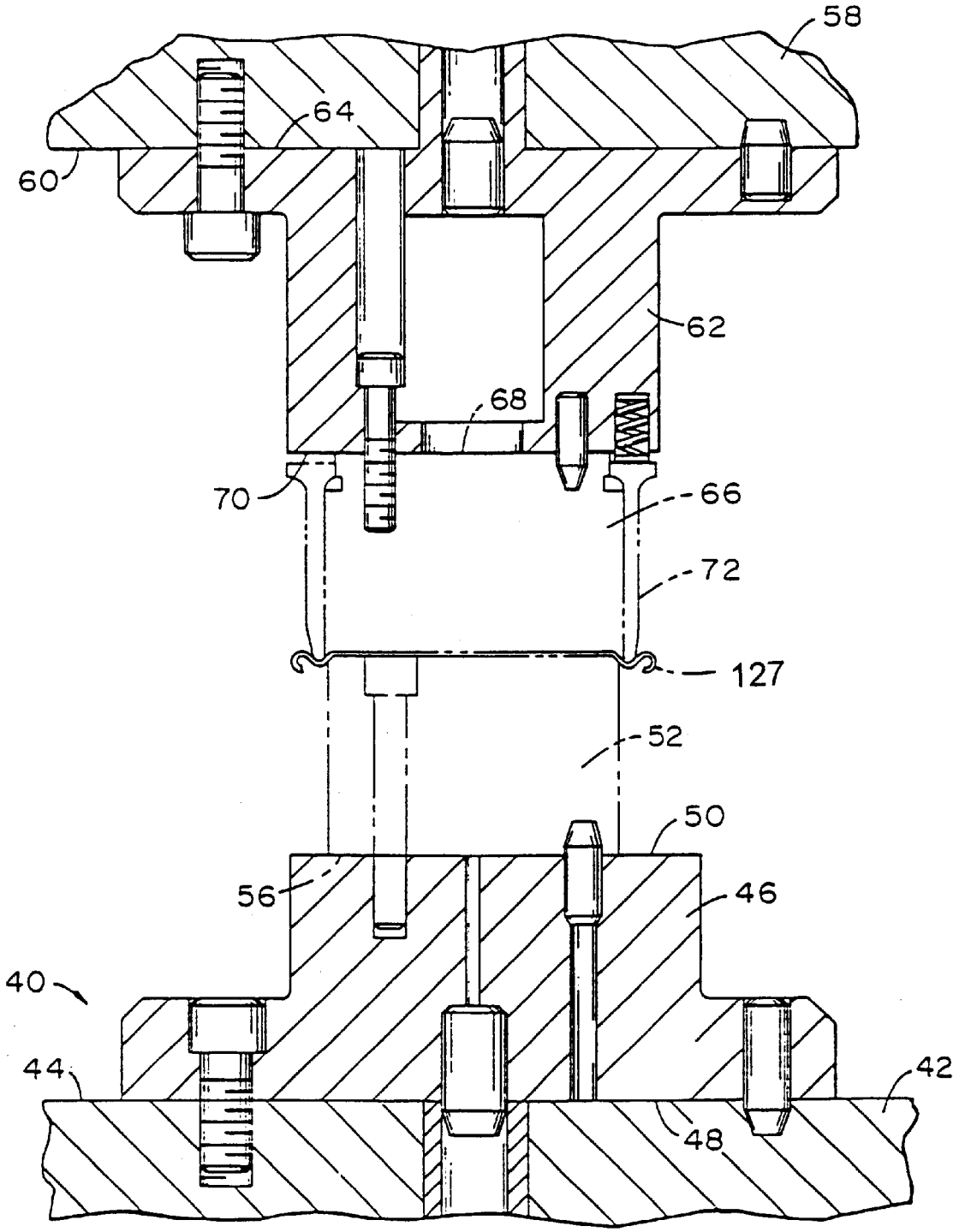
FIG. 1 is a cross sectional view illustrating the press ram, tool support means, ram, upper and lower tool members, a support base, and a stationary press bed of a typical prior art tooling station in a conversion press.

The manufacture of a can end shell into an easy-open can end takes place in a conversion press, a portion of which is shown in FIG. 1. The Minster Machine Company of Minster, Ohio manufactures and sells an industrial press suitable for configuration as a can end conversion press. The conversion press 40 generally include a stationary press bed 42 including a generally planar horizontal upper surface 44. The upper surface supports a tooling base 46 which has a planar bottom surface 48 and a planar upper surface 50. Positioned upon the upper surface of tooling base is a lower tooling member 52 (shown in phantom) which make take a variety of shapes depending upon the tooling operation to be performed on the can end shell 127. However, each lower tooling member 52 has a planar bottom surface 56 which mates with the upper surface 50 of the tooling base 46 to provide secure support for the lower tooling member 52.

A vertically displaceable press ram 58 overlies press bed and includes a generally planar horizontal lower surface 60. This surface 60 of the press ram 58 supports a tool support means 62 which may take a plurality of shapes depending upon the type selected for a particular tooling operation. In general, however, the tooling support means or base 62 includes an upper planar surface 64 which provides solid mating contact with the surface 60 of the press ram 58 so that the tooling support means 62 is securely fastened to the press ram. The tool support means 62 securely supports an upper tooling member (shown in phantom) 66 having an upper planar surface 68 that is in mating contact with the lower planar surface 70 of the tool support means 62. The upper tooling member 66 can be one of many shapes and sizes depending upon the particular tooling operation to be performed. Typically, a centering ring 72 locates the can end shell 54 in each tooling station. The various types of tooling operations to be performed in succession include: bubble forming in the center of the open can lid, forming the bubble into a button; scoring an opening; paneling the can end in an area surrounding the scored opening; staking the pull tab to the can end; and stamping incise lettering upon the can end for messages such as "lift up, pull back" or "dispose of properly". U.S. Pat. No. 4,610,156, which is assigned to the assignee of the instant invention, sets forth a detailed description of the various tooling stations of a conversion press. The contents of this patent are incorporated herein by reference as if fully set forth. The can end conversion process may require from six to eight stations in which differently configured tooling carries out successive cold-working of the metal in the several steps in the conversion of a can end shell in an easy-open can end.

Figure 2:
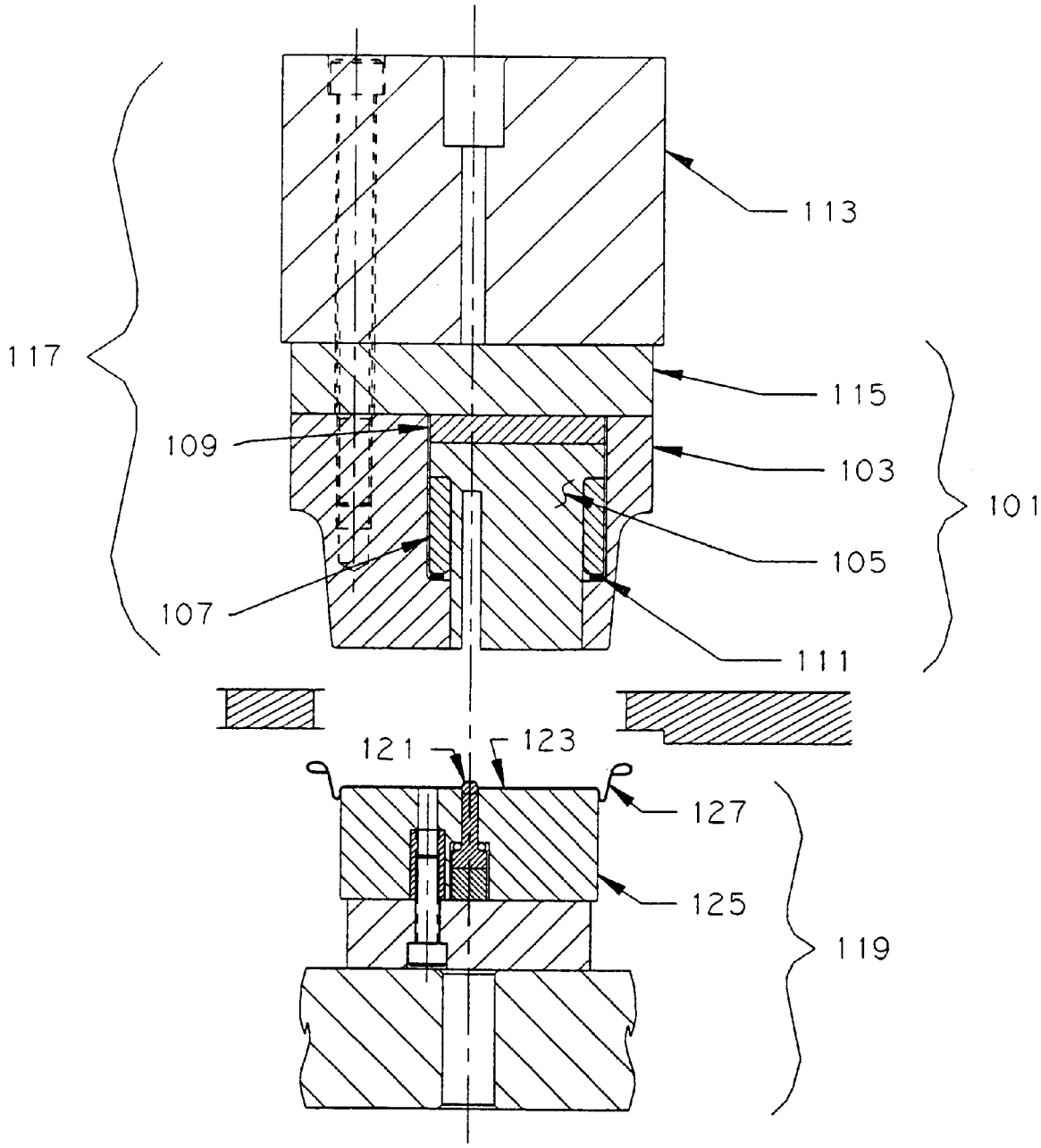
FIG. 2 is a sectional view of the modular tooling system of this invention which is adapted for use in a conversion press.

It is to be appreciated that the modular tooling system of this invention as described below replaces the tooling shown in FIG. 1. Turning to FIG. 2, there is illustrated the modular tooling system of this invention, generally indicated by the reference character 101. The modular tool system 101 includes a modular holder 103 in which an insert 105 is removably seated. The insert 105 is supported within the modular holder 103 by means of a bushing 107, a spacer 109, and a biasing means such as spacer 111. The modular tool system 101 is mounted onto an upper-base 113 adapted to receive the modular tooling, preferably with a spacer member 115 disposed thereinbetween. The entire upper tooling assembly, generally indicated by the reference character 117, is mounted into the conversion press, in substantially the same manner, e.g., bolting, as described in connection with the tooling assembly as illustrated in FIG. 1. Also shown in FIG. 2 is a portion of the lower tooling station assembly 119, which cooperates with the modular tool system 101 or upper tooling station. The lower tooling station 119 has a rivet pin or centering post 121 which extends upwardly from the anvil-like surface 123 of the lower tooling member 125. The rivet pin 121 more precisely locates the partially converted end on the lower tooling member. An end shell 127 is seated on the anvil-like surface 123 of the lower tooling member 125.

Figures 3A, 3B:
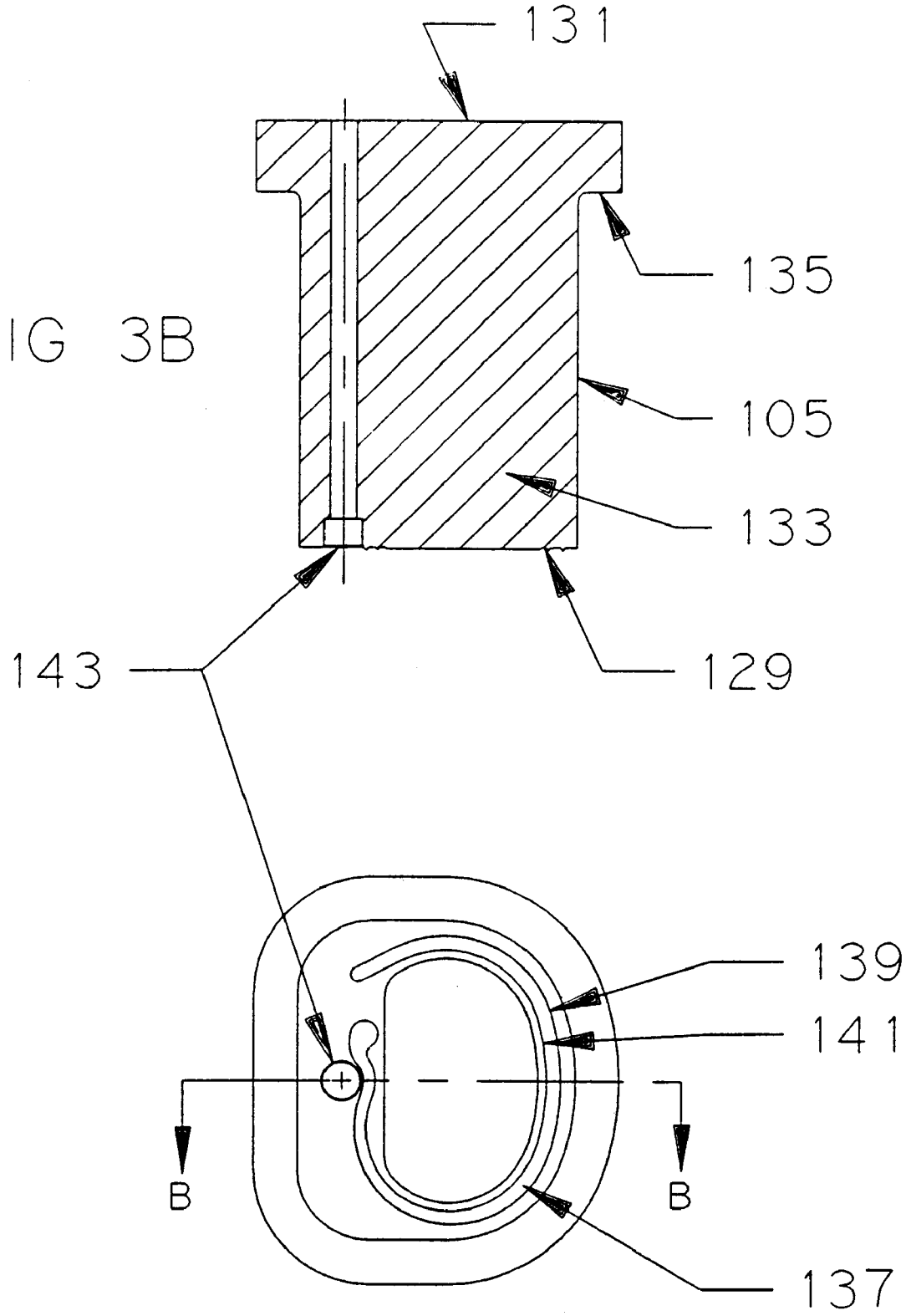
FIGS. 3A and 3B are a plan view of the working face of the insert of the modular tooling system and a sectional view along lines 3B—3B of the working face of the insert.

Turning to FIGS. 3A and 3B, the insert 105 has a first end 129, a second end 131 opposite thereto, and an intermediate portion 133 thereinbetween. The intermediate portion 133 defines a step-like shoulder portion 135 proximate the second end 131 and substantially parallel with the ends 129 and 131 of the insert 105. For illustrative purposes, the insert 105 is described as the score tooling for an easy open end. It is to be appreciated that the wear tooling of other stations within the conversion press can advantageously incorporate the concepts of this invention. The first end 129 includes the metal working features 137 for the scoring of the panel of the end shell. The features 137 are a main score 139 and an anti-fracture score 141. A bore 143 extends through the body of the insert and provides a relief which cooperates with the rivet pin 121 of the lower tooling assembly 119.

Figure 4:
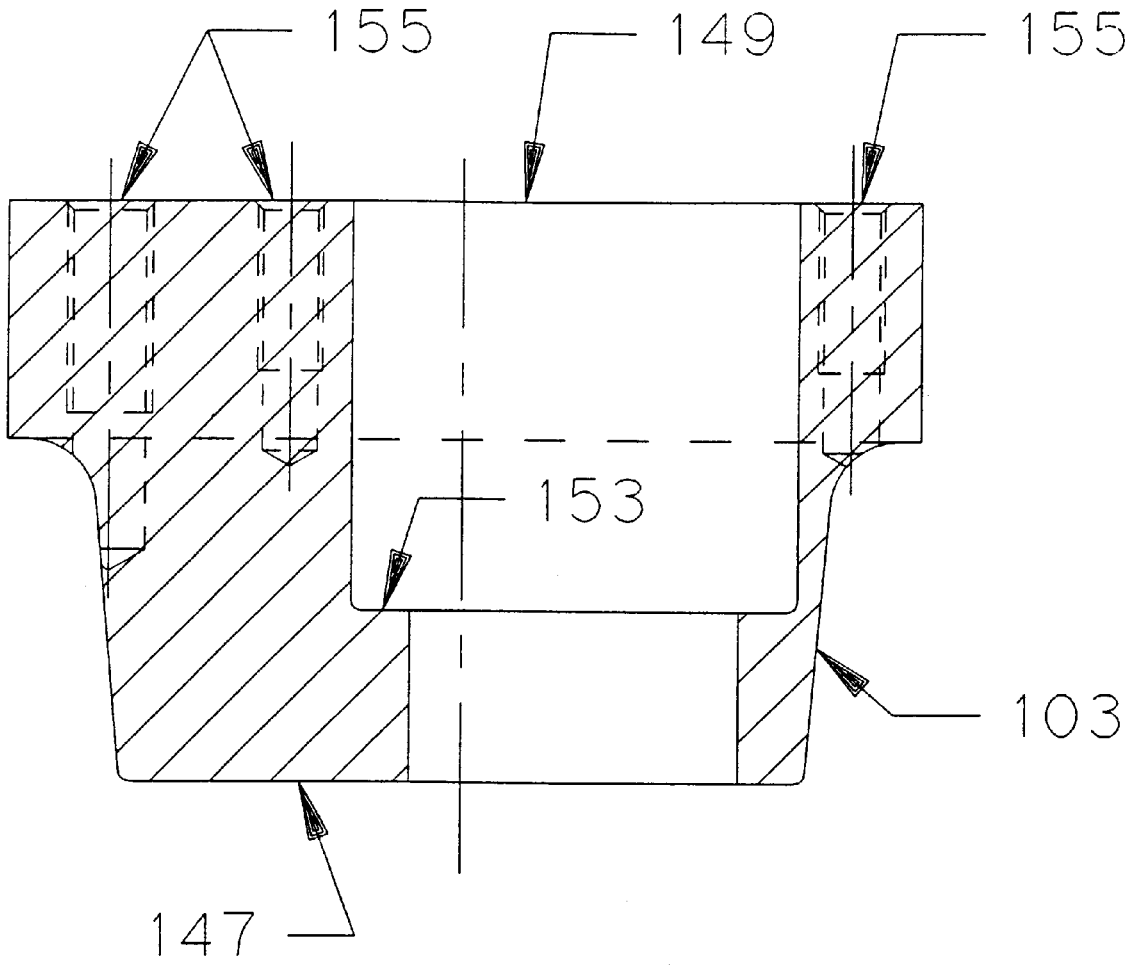
FIG. 4 is a sectional view of the modular holder of this invention in which the insert is removably seated.

The modular holder 103 is shown in FIG. 4 and has body 145 with a first face 147 and a second face 149. The body 145 defines a chamber-like portion 151 adapted to receive therein the insert 105. Preferably, the chamber 151 has an irregular through shape or outside diameter that functions as a locating means for the alignment of the insert within the chamber. The chamber 151 has a step-like shoulder portion 153 which is substantially parallel with the faces 147 and 149 of the modular holder 103. The shoulder 153 cooperates with the insert's shoulder portion 135 (see FIG. 2); with the result that chamber 151 properly receives the insert 105 by the insertion of the first end 129 through the open portion of the chamber proximate the second face 149 of the holder 103. The modular holder 103 includes a plurality of bores as at 155 by which the components are located or aligned relative to each other and by which fastening means secure the holder 103 to the upper base 113.

With reference to FIG. 2, the insert 105 and the chamber 151 have complementary cross-sectional configurations so that the insert 105 is keyed to the modular holder 103. Additionally, a bushing 107 is disposed between the insert 105 and the wall of the chamber 151, extending between the shoulder portion 135 of the insert and the shoulder portion 153 of the chamber. The bushing has a cross-sectional configuration which is also complementary with the insert and the modular holder. A biasing means 111, such as an o-ring, is disposed between the bushing 107 and the chamber 151 in order to compensate for machining and assembly tolerances in the modular tool system 101. An insert spacer 109 is positioned on top of the second face 131 of the insert 105. As will be explained below, the modular tool system 101 includes a number of spacers 109 and bushings 107 which cooperate with the insert 105 in order to compensate for reductions in the overall length of the insert 105 each time the insert is refurbished. The modular assembly includes the spacer 115.

The insert 105 can be formed of a material selected from the group consisting of carbide, ceramic, and hardened tool steel and the modular tool holder 103 can be manufactured of tool steel. As the working features, such as the knife edges, shows unacceptable wear, the modular tool system 101 is removed from the conversion press and the insert 105 refurbished. The refurbishing can be accomplished by the use of EDM processing followed by grinding and polishing. Carbide demonstrates excellent wear properties and can be refurbished without the need for a subsequent application of a protective coating.

Figure 5:
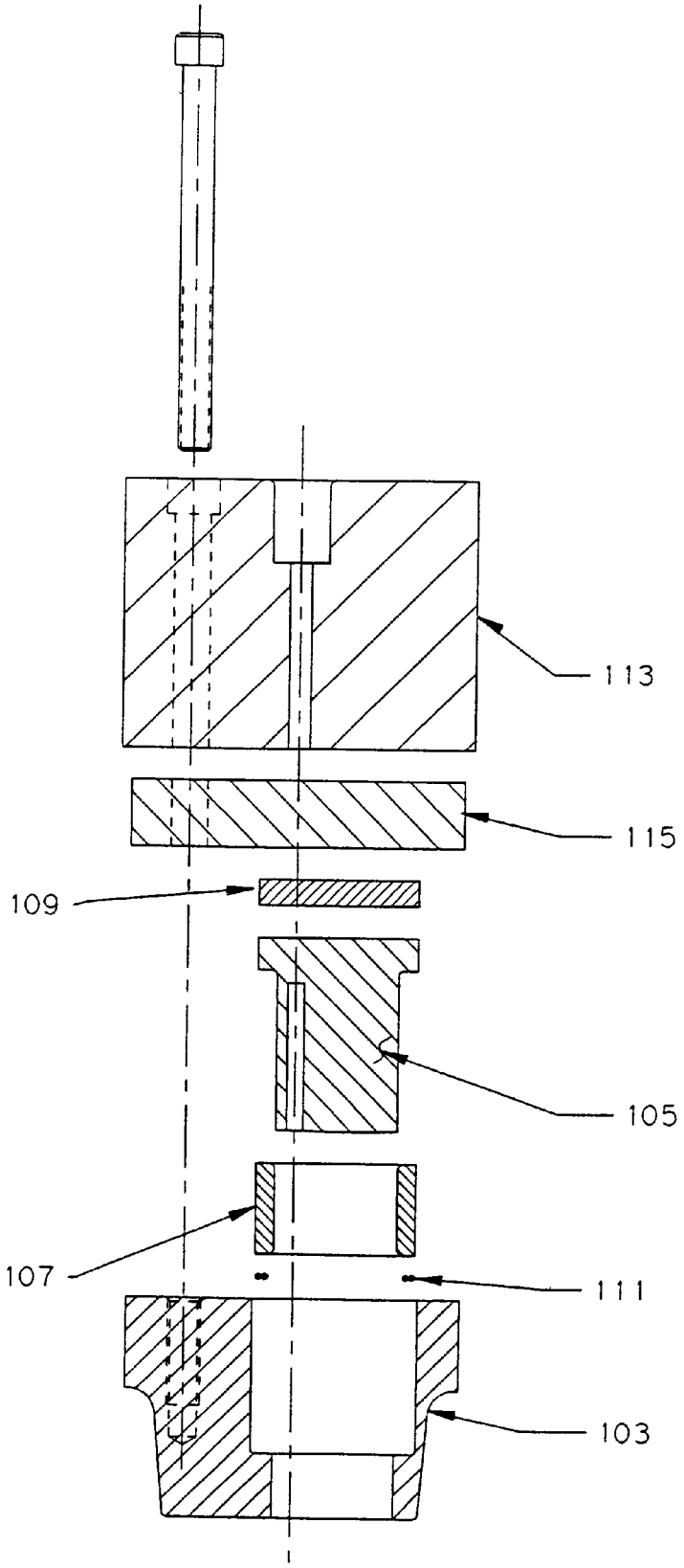
FIG. 5 is an exploded, cross sectional view of the modular holding station tool holder, insert, and spacers.

The modular tooling system lends itself to a method of repair and replacement of wear tooling used in a conversion press. The disassembly, refurbishing, and reassembly of the modular tool system 101 will be described in conjunction with FIG. 5. As circumstances warrant the replacement of a tooling element in the lane tooling of the press, the modular tool system 101 is removed from the press. The modular system 101 is detached form the base 113. Typically, a spacer 115 is located between the upper base 113 and the holder 103. The keyed spacer 109, insert 105, and bushing 107 are removed from the holder 103. A predetermined amount of face material as at 129 may be removed in order to effect the necessary repair of the working features 137 of the insert. This reduces the overall length of the insert. Additionally, because the insert is keyed, it can be mounted in a work holding device (not shown) during repair in order to ensure that the new working features will be accurately located on the insert. The reduced overall length of the insert is compensated for during reassembly by the use of a shorter bushing 107 and a thicker spacer 109. The spacer 109 is of a thickness selected to provide the proper positioning of the working features of the insert 105 during the operation of the conversion press. Accordingly, the amount of material removed from the overall length of the insert is equivalent to both the reduction in the length of the bushing and the increase in the thickness of the spacer. The biasing means 111 may be utilized to compensate for any machining and assembly tolerance requirements.

What has been described is a modular tooling system specifically adapted for use in a conversion press for the manufacture of can ends.

What is claimed is:

1. A modular tooling system comprising:

a tooling holder having a first face and a second face opposite thereto, and a body portion defining a chamber therein extending from said first face to said second face, said chamber being of a predetermined cross section and having a shoulder portion therein;

an insert adapted to be removably mounted in said tool holder and having a predetermined cross section adapted to correspond with chamber cross section, said insert having a first end, a second end, and a shoulder portion adapted to cooperate with said insert shoulder portion; and means for retaining said insert in said tooling holder, said means including a bushing disposed between said insert and said tooling holder.

2. The modular tooling system according to claim 1 wherein the predetermined cross section of the insert and the tooling holder chamber define key means for the alignment of the insert relative to the tooling holder.

3. The modular tooling system according to claim 1 wherein the means for retaining the insert in the tooling holder includes biasing means.

4. The modular tooling system according to claim 1 wherein the means for retaining the insert comprise at least one set of spacers of a first dimension and at least a second set of spacers of a second, different dimension.

5. The modular tooling system according to claim 1 wherein the insert consists of a material selected from the group consisting of carbide, ceramic, or tool steel.

6. The modular tooling system according to claim 1 wherein the tool holder consists of tool steel.

7. The modular tooling system according to claim 1 in combination with a conversion press for the processing of end shells.

8. The modular tooling system according to claim 1 wherein the insert first end has working features for further forming an end shell.

9. The modular tooling system according to claim 8 wherein the working features include knife edges for the formation of score lines on the end shell.

10. A modular tooling system for use in combination with a conversion press comprising:

an upper base member adapted to be removably mounting into the conversion press;

a tooling holder having a first face adapted for attachment to said upper base member, and a second face opposite thereto, and defining a chamber therein extending from said first fact to said second face, said chamber having a shoulder portion, a tooling insert adapted to be removably mounted in said tool holder, said insert having a first end, a second end, and a shoulder portion adapted to cooperate with said insert shoulder portion; and means for retaining said tooling insert in said tooling holder, said means including a bushing disposed between said tooling insert and said tool holder.

11. The combination according to claim 10 wherein the tooling holder chamber has a predetermined cross section and the tooling insert has a predetermined cross section adapted to correspond with said chamber cross section to define a key like relationship.

12. The combination according to claim 10 wherein the means for retaining the insert in the tooling holder includes biasing means.

13. The combination according to claim 10 wherein the means for retaining the insert comprise at least one set of spacers of a first dimension and at least a second set of spacers of a second, different dimension.

14. The combination according to claim 10 wherein the insert consists of a material selected from the group consisting of carbide, ceramic, or tool steel.

15. The combination according to claim 10 wherein the tool holder consists of tool steel.

16. The combination according to claim 10 wherein the tooling insert first end has working features for further forming an end shell.

17. The combination according to claim 16 wherein the working features include knife edges for the formation of score lines on the end shell.

18. A modular tooling system comprising:

a tooling holder having a first face and a second face opposite thereto, and a body portion defining a chamber therein extending from said first face to said second face, said chamber having a shoulder portion therein;

an insert adapted to be removably mounted in said tool holder and having a first end, a second end, and a shoulder portion adapted to cooperate with said insert shoulder portion; and means for retaining said insert in said tooling holder, said means including a bushing disposed between said insert and said tooling holder.

19. The modular tooling system according to claim 18 wherein the insert and the tool holder chamber are each of a predetermined cross section so as to define key means for the alignment of the insert relative to the tooling holder.

20. The modular tooling system according to claim 18 wherein the means for retaining the insert in the tooling holder includes biasing means.

21. The modular tooling system according to claim 18 wherein the means for retaining the insert comprise at one set of spacers of a first dimension and at least a second set of spacers of a second, different dimension.

22. The modular tooling system according to claim 18 wherein the insert consists of a material selected from the group consisting of carbide, ceramic, or tool steel.

23. The modular tooling system according to claim 18 wherein the tool holder consists of tool steel.

24. The modular tooling system according to claim 18 in combination with a conversion press for the processing of end shells.

25. The modular tooling system according to claim 18 wherein the insert first end has working features for further forming an end shell.

26. The modular tooling system according to claim 25 wherein the working features include knife edges for the formation of score lines on the end shell.

27. A modular tooling system comprising:

a tooling holder having a first face and a second face opposite thereto, and a body portion defining a chamber therein extending from said first face to said second face, said chamber being of a predetermined cross section and having a shoulder portion therein;

an insert adapted to be removably mounted in said tool holder and having a predetermined cross section adapted to correspond with said chamber cross section, said insert having a first end, a second end, and a shoulder portion adapted to cooperate with said insert shoulder; and means for retaining said insert in said tooling holder, said means comprising at least one set of spacers of a first dimension and at least a second set of spacers of a second different dimension.

28. The modular tooling system according to claim 27 wherein the means for retaining the insert in the tooling holder chamber includes a bushing disposed between the insert and the tooling holder.

29. The modular tooling system according to claim 27 wherein the predetermined cross section of the insert and the tooling holder chamber define key means for the alignment of the insert relative to the tooling holder.

30. The modular tooling system according to claim 27 wherein the means for retaining the insert in the tooling holder includes biasing means.

31. A modular tooling system for use in combination with a conversion press comprising:

an upper base member adapted to be removably mounting into the conversion press;

a tooling holder having a first face adapted for attachment to said upper base member, and a second face opposite thereto, and defining a chamber therein extending from said first fact to said second face, said chamber having a shoulder portion;

a tooling insert adapted to be removably mounted in said tool holder, said insert having a first end, a second end, and a shoulder portion adapted to cooperate with said insert shoulder portion; and means for retaining said tooling insert in said tooling holder, said means including a bushing and a braising means disposed between said tooling insert and said tooling holder.

32. The combination according to claim 31 wherein the tooling holder chamber has predetermined cross section and the tooling insert has a predetermined cross section adapted to correspond with said chamber cross section to define a key like relationship.

33. The combination according to claim 31 wherein the means for retaining the insert comprise at least one set of spacers of a first dimension and at least a second set of spacers of second, different dimension.

34. A modular tooling system for use in combination with a conversion press comprising:

an upper base member adapted to be removably mounting into the conversion press:

a tooling holder having a first face adapted for attachment to said upper base member, and a second face opposite thereto, and defining a chamber therein extending from said first fact to said second face, said chamber having a shoulder portion, means for retaining said tooling insert in said tooling holder including at least one set of spacers of a first dimension and a least a second set of spacers of a second, different dimension, wherein one of said sets of spacers is selectively used in said means for retaining said tooling insert in said tooling holder.

35. The combination according to claim 34 wherein the tooling holder chamber has a predetermined cross section and the tooling insert has a predetermined cross section adapted to correspond with said chamber cross section to define a key like relationship.

* * * * *